United States Patent [19]

Neely

[11] 4,212,415

[45] Jul. 15, 1980

[54] HOUSING AND MODULE THEREFOR

[75] Inventor: Raymond J. Neely, Montgomeryville, Pa.

[73] Assignee: Refreshment Machinery Incorporated, Warminster, Pa.

[21] Appl. No.: 868,162

[22] Filed: Jan. 9, 1978

[51] Int. Cl.[2] ..... G01F 11/00; B65D 11/18

[52] U.S. Cl. ..... 222/231; 220/4 D; 220/307; 220/324

[58] Field of Search ..... 222/231, 236; 220/4 C, 220/4 D, 354, 355, 306, 307, 308, 339, 358, 324, 326

[56] References Cited

U.S. PATENT DOCUMENTS

| | | | |
|---|---|---|---|
| 3,458,089 | 7/1969 | Maxson et al. | 222/231 |
| 3,485,408 | 12/1969 | Benesch | 220/4 C |
| 3,840,152 | 10/1974 | Hodge | 220/306 |
| 4,000,816 | 1/1977 | Spruyt | 220/339 X |

*Primary Examiner*—Robert J. Spar
*Assistant Examiner*—Edward M. Wacyra
*Attorney, Agent, or Firm*—Seidel, Gonda, Goldhammer & Panitch

[57] ABSTRACT

A housing such as a dispensing canister is constructed of a plurality of modules removably interconnected together. The lowermost module has a screw for dispensing granular material and an agitator driven by the screw.

9 Claims, 8 Drawing Figures

HOUSING AND MODULE THEREFOR

SUMMARY OF THE INVENTION

A housing module in accordance with the present invention is preferably in the form of a rectangular polymeric plastic body having an integral loop projecting outwardly from opposite walls at the upper end thereof. At least one integral tab projects from the lower end of each of said walls. Each tab has a shoulder spaced from the lower end of its associated wall by a distance slightly less than the vertical height of the loops on the upper end of said walls. Each tab is constructed so that it may extend downwardly through a loop on another housing module and be latched thereto by contact between the tab shoulders and a surface on the loops of the other housing. The tabs are preferably connected to a cam follower which cooperates with a stationary cam on the body adjacent the loops.

A plurality of said modules may be interconnected together to form housings of different height. The uppermost module is provided with an access lid to facilitate introducing granular material into the housing. The lowermost module is preferably provided with means to facilitate dispensing and agitation of the granular material.

It is an object of the present invention to provide a novel housing and modules therefor which may be removably connected together to form the housing.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
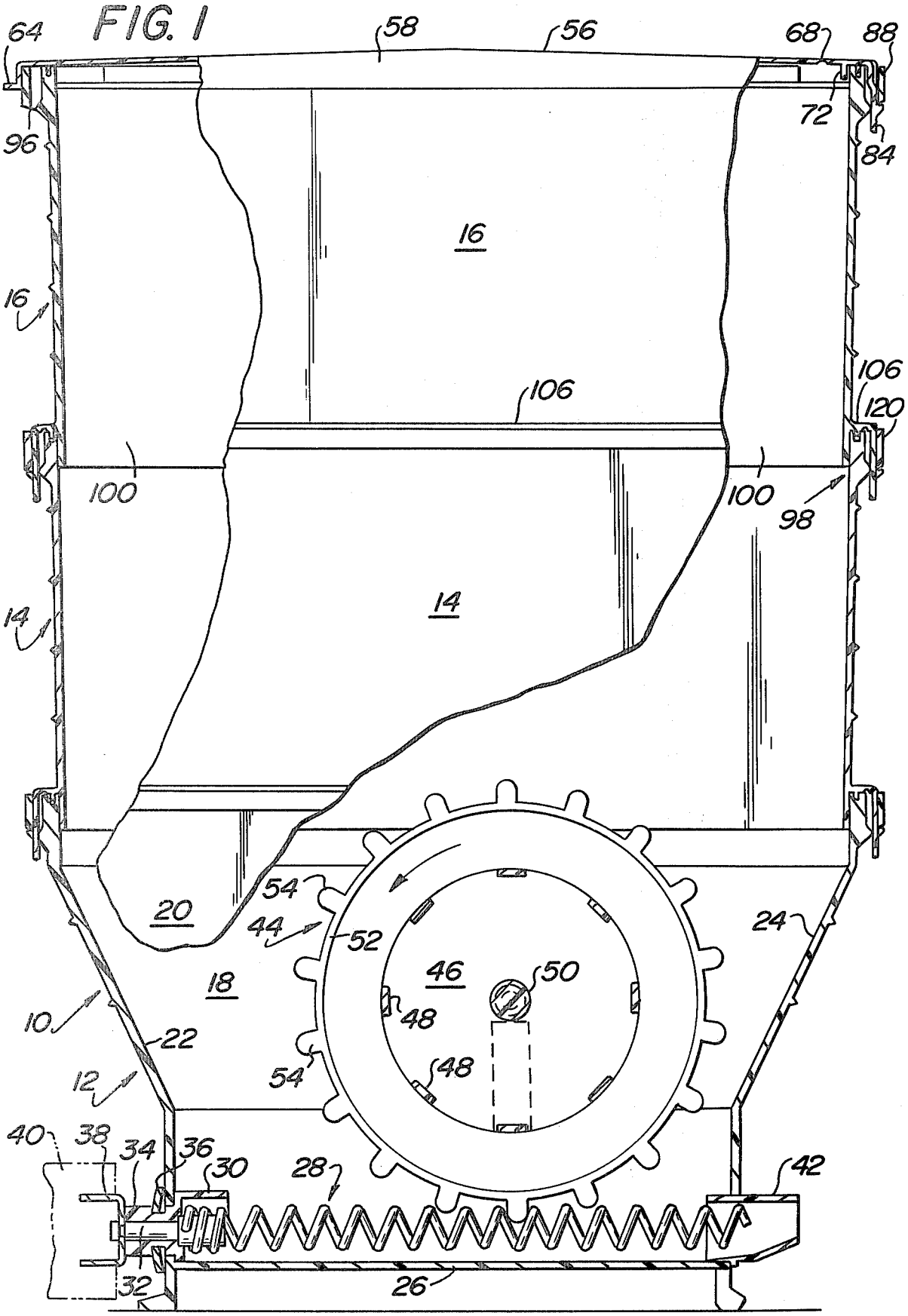
FIG. 1 is a side elevation view, partly in section, of the housing in accordance with the present invention.

Referring to the drawings in detail, wherein like numerals indicate like elements, there is shown in FIG. 1 a dispensing housing in accordance with the present invention designated generally as 10. The housing 10 is comprised of modules 12, 14 and 16 interconnected with each other in a manner to be described hereinafter.

Referring to FIG. 1, the lowermost module 12 is comprised of a body mounted on legs and having side walls 18 and 20 interconnected in one piece with end walls 22, 24. Each of said walls is integral in one piece with a bottom wall 26. Thus, the body of module 12 is preferably molded in one piece from a polymeric plastic material so as to have an open top.

The lowermost module 12 is provided with means for dispensing a granular material therefrom, namely a screw means 28. The screw means 28 is preferably a helically arranged screw made from wire. Other types of screws may be utilized. The screw means 28 extends for substantially the entire length of the module 12 adjacent the bottom wall 26.

A guard 30 is attached to end wall 22 and extends inwardly contacting the side walls 18 and 20 causing a longitudinal seal. Guard 30 overlies one end portion of the screw means 28 adjacent the location where screw means 28 is connected to a pin 32. Pin 32 extends through a bearing 34 secured in a hole in end wall 22. Bearing 34 is preferably integral in one piece with the guard 30. Bearing 34 is retained in place by retaining ring 36 having a radial arc so as to perfect a seal and keep a constant tension between the end wall 22 and the shoulder of guard 30. Pin 32 terminates in a driver 38 adapted to be driven by a motor 40.

At the opposite end of the screw means 28, the end wall 24 is provided with an opening in which is mounted a spout 42. Spout 42 is secured to end wall 24 in any convenient manner such as by screws. Spout 42 is coaxial with the screw means 28. As shown at the lower righthand end of FIG. 1, the screw means 28 extends into the spout 42. Spout 42 constitutes a discharge outlet and through which granular material can be dispensed from the module 12.

An agitator designated generally as 44 is provided within the module 12 and supported by the side walls 18 and 20. The agitator 44 includes a vertically disposed disk 46 having a plurality of circumferentially arranged baffles 48 projecting to opposite sides thereof. While eight baffles project from the opposite sides of disk 46, a greater or lesser number may be provided as desired. The disk 46 is provided with an axle 50. Axle 50 is rotatably supported at its ends thereof by the side walls 18, 20.

The flexibility of the walls 18, 20 facilitates installing and removal of the agitator 44. Thus, the walls may be manually bowed away from one another to permit the axle 50 to be mated with hub structure on the walls 18, 20.

At the periphery of disk 46, it is provided with a circumferential flange 52. Flange 52 is provided with a plurality of teeth 54 circumferentially disposed therearound. While 18 teeth 54 are shown, equally spaced around the periphery of disk 46, a greater or lesser number may be provided. Each of the teeth 54 is adapted to mesh with the screw means 28. Thus, as screw means 28 rotates about its longitudinal axis, the agitator 44 will rotate about a transverse axis.

Figure 2:
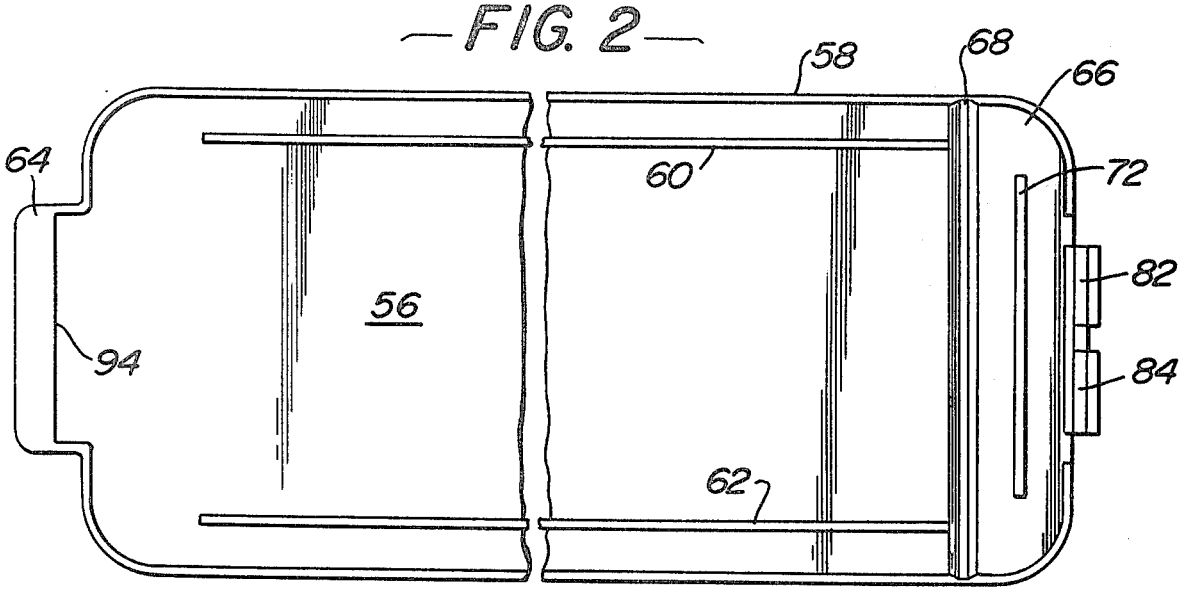
FIG. 2 is a bottom plan view of the cover attached to the uppermost module.

Access to the interior of the housing 10 is attained by way of a cover 56 connected to the upper end of the upper module 16. A bottom plan view of the cover 56 is shown in FIG. 2. Cover 56 has a depending peripheral flange 58 adapted to be juxtaposed to the outer periphery of the upper module 16 when the cover 56 is in a closed position as shown in FIG. 1. Spaced inwardly from the flange 58, a pair of flanges 60, 62 depend downwardly from cover 56. Each of the flanges 60, 62 is adapted to enter into the upper end portion of the upper module 16 in the closed position of the cover 56. Thus, the distance between flange 60 and the juxtaposed portion of flange 58 is slightly greater than the thickness of the upper end of the upper module 16. The vertical height of flange 62 is slightly less than the vertical height of flange 58 as shown more clearly in FIG. 7.

The cover 56 has a movable portion and a stationary portion 66. The movable portion is substantially greater in length than the stationary portion and terminates in one end at a tab 64. The movable portion of the cover 56 is connected to the stationary portion by a hinge 68. See FIGS. 2 and 7. Hinge 68 is preferably attained by a thin section of the material. The peripheral flange 58 is provided with a slit 70 at the hinge. Flanges 60, 62 terminate at hinge 68.

The stationary portion 66 of the cover 56 on its inner surface is provided with a downwardly extending flange 72. See FIGS. 2 and 7. At the end of portion 66 remote from the hinge 68, there is provided a rigid downwardly extending wall 74 generally perpendicular to the portion 66. Wall 74 is provided with side flanges 76 and terminates in a shoulder 78. Side flanges 76 prevent section 66 from lifting upward when lid is opened. An extension 80 extends downwardly from shoulder 78. As shown more clearly in FIG. 7, extension 80 is offset with respect to the wall 74.

Figure 3:
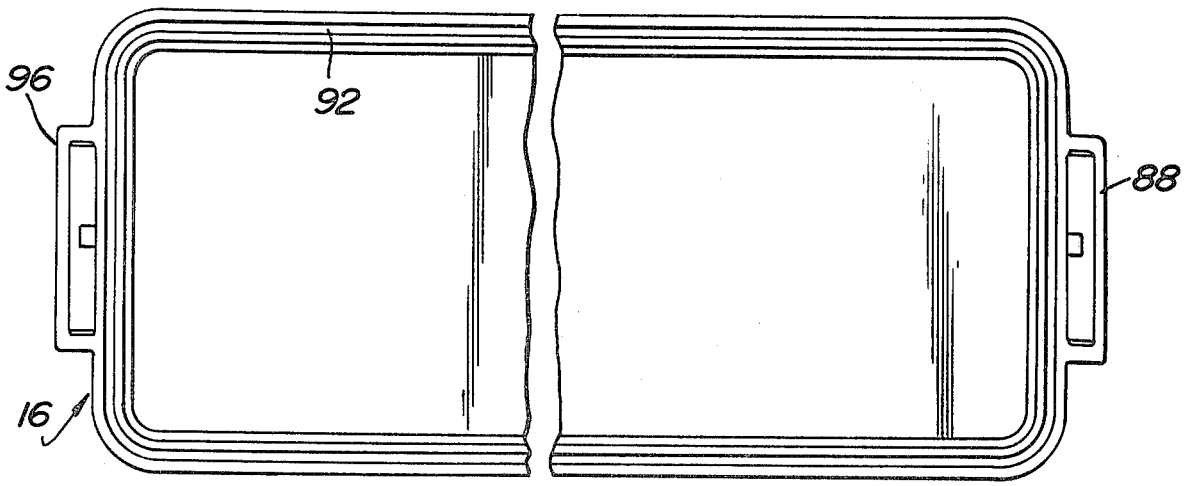
FIG. 3 is a top plan view of the uppermost module with the cover removed.
Figure 4:
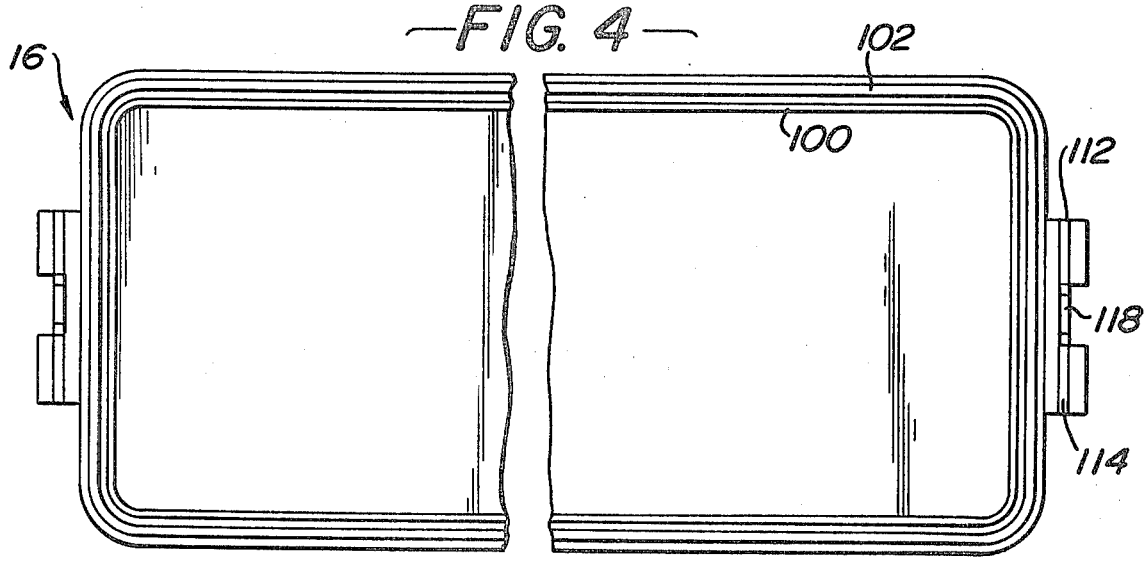
FIG. 4 is a bottom plan view of the module shown in FIG. 3.

The extension 80 is provided with a pair of spaced tabs 82 and 84 extending downwardly therefrom. Each tab has a projection thereon. Each projection has an upwardly inclined locking surface 86. At the upper end of module 16, there is provided a closed loop 88 through which elements 74–84 extend. The locking surfaces 86 engage the lowermost surface on the loop 88. The upper edge of module 16 is provided with a groove 90 within which is disposed a seal 92. As shown more clearly in FIG. 3, seal 92 extends around the entire upper periphery of the module 16.

When the cover 56 is supplied to the upper end of the module 16, the peripheral flange 58 overlies the outer periphery and flanges 60, 62 and 72 are disposed adjacent the inner periphery of said upper edge of module 16. Lid 56 is provided with a recessed portion 94 for receiving therewithin loop 96. Loop 96 is on the opposite wall from loop 88 of module 16.

Figure 7:
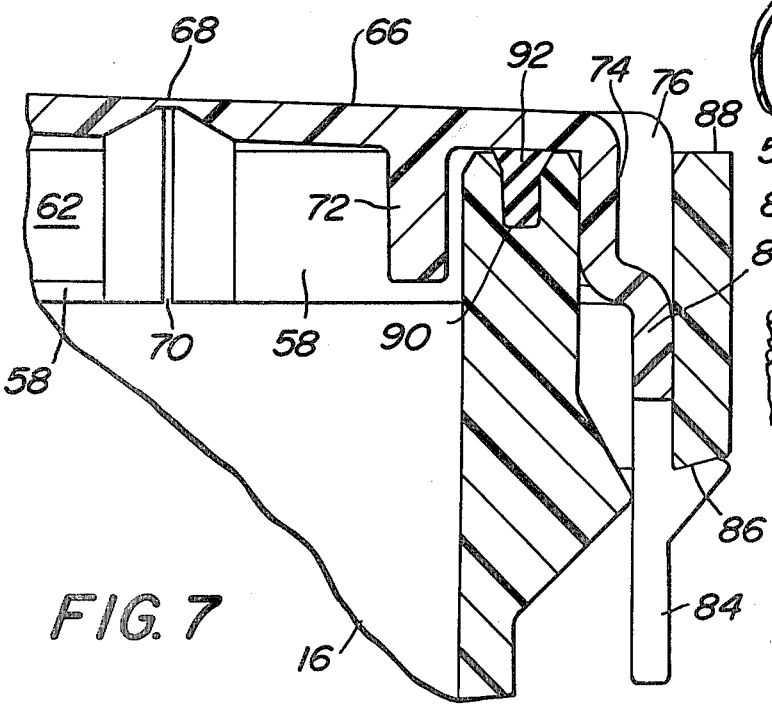
FIG. 7 is an enlarged sectional view of the coupling between the cover and the upper module as shown in the upper righthand corner of FIG. 1.
Figure 8:
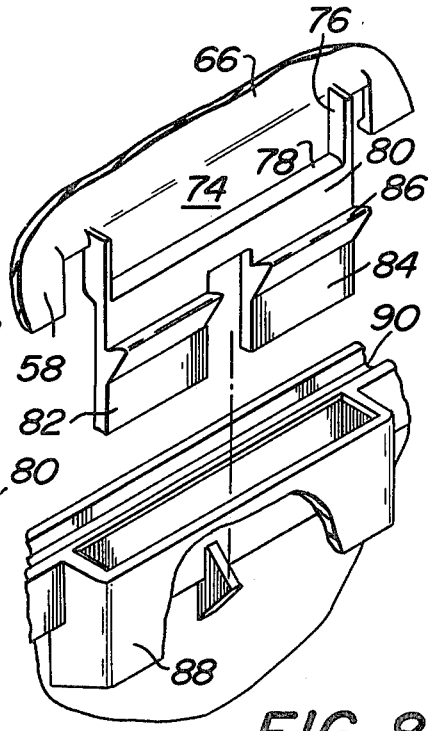
FIG. 8 is an exploded partial perspective view of the structure shown in FIG. 7.

Module 16 is connected to module 14 in the same manner that module 14 is connected to module 12. Each module is connected to the next adjacent module by a pair of locking means on opposite walls. Each of the locking means in the pair is identical. The locking means for cover 56 is shown in FIGS. 7 and 8. Only locking means 98 which joins one end of module 16 to one end of module 14 will be described in detail.

Figure 5:
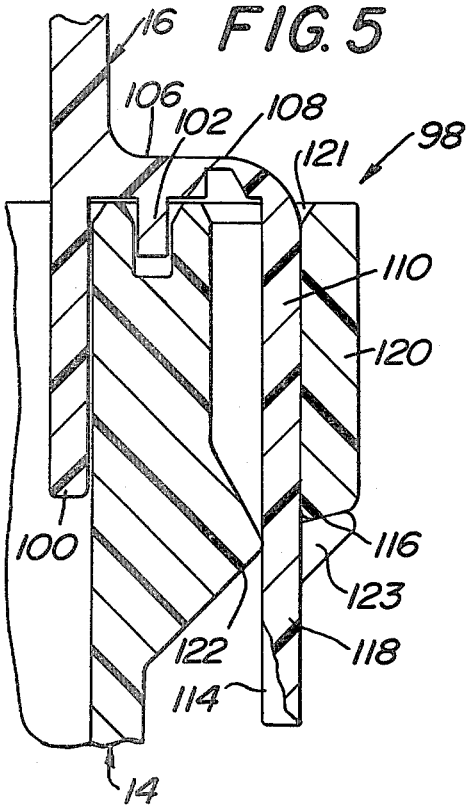
FIG. 5 is a cross-sectional view of the interlock between housing modules on an enlarged scale.
Figure 6:
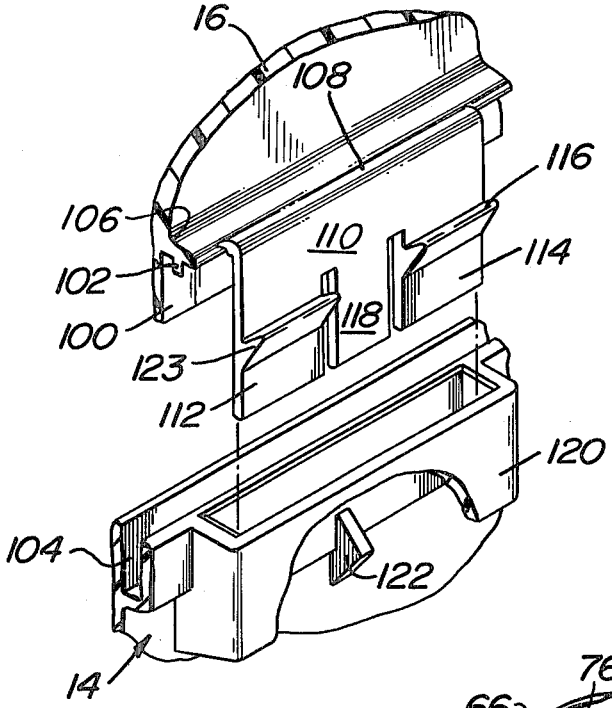
FIG. 6 is an exploded partial perspective view of the interlock between housing modules.

Referring to FIGS. 1, 5 and 6, module 16 has a downwardly extending flange 100 which telescopes into the module 14 and a horizontally outwardly disposed rim 106. From rim 106, there is provided a depending tongue 102 which extends into a peripheral groove 104 on the upper edge of module 14 thereby forming a labyrinth seal. Groove 104 is identical with groove 90 on the upper edge of module 16.

A tab 110 is pivotably connected to the periphery of rim 106 by a living hinge 108. Hinge 108 is formed by a thinned portion of the tab 110. Tab 110 is provided with a pair of spaced extensions 112, 114. Each tab has a cam 123 with an upwardly inclined locking surface 116. Between the extensions 112, 114, there is provided a cam follower 118. Cam follower 118 is discrete from the extensions 112, 114 and is generally in the same plane.

A loop 120 is provided adjacent the upper end of module 14. Tab 110 extends through the loop 120 and locking surfaces 116 engage the bottom surface of loop 120. Due to the resiliency of the polymeric plastic material, the tab 110 has a tendency to pivot in a counterclockwise direction in FIG. 5. Tab 110, being connected to rim 106 by a hinge known in the state of the art as a living or infinite hinge, will not have sufficient force to return to its original position and maintain surfaces 116 in contact with the bottom surface of loop 120. Accordingly, a cam 122 is provided on the module 14 in a position so as to contact cam follower 118 and bias the entire tab 110 in a counterclockwise direction in FIG. 5 thereby providing the necessary contact between surfaces 116 and loop 120.

As the tab 110 enters the loop 120, the extensions 112 and 114 are cammed inwardly due to contact by the underside of their cam 123 against the inner edge 121 of loop 120. As further engagement occurs, cam follower 118 starts to engage cam 122 causing an opposite outward force on the complete tab 110. When full engagement is completed, the resiliency of the plastic material causes the cam follower tab 118 to force the extensions 112 and 114 back to their original outward position causing surface 116 of cams 123 to spring outwardly and under loop 120 thereby causing a positive locking action. In order to separate the modules, the extensions 112 and 114 are simultaneously depressed toward outer wall 14 while exerting a force on the modules in an axial direction.

From the above description, it should be apparent to those skilled in the art that the housing 10 may be constructed of any number of modules. The various modules, except for the lowermost module 12, are identical. On the uppermost module, the cam corresponding to cam 122 performs no function but does not interfere with locking the cover to the uppermost module. Each module is an integral molded polymeric plastic material such as polypropylene, etc.

The present invention may be embodied in other specific forms without departing from the spirit or essential attributes thereof and, accordingly, reference should be made to the appended claims, rather than to the foregoing specification as indicating the scope of the invention.

It is claimed:

1. A housing module comprising a rectangular plastic body having an integral loop projecting outwardly from opposite walls at the upper end thereof, at least one integral tab projecting from the lower end of each of said walls, each tab having a locking surface spaced from the lower end of its associated wall by a distance slightly less than the vertical height of the loop on the upper end of its associated wall, each tab being constructed so that it may extend downwardly through a loop on another housing module and be latched thereto by contact between its locking surface and a surface of the loop on the other housing module, the upper edge of said body being provided with a groove, the lower edge of said body having a tongue adapted to enter the groove on said another housing module to form a labyrinth seal.

2. A module in accordance with claim 1 including a cam follower adjacent said tab, and a cam on the outer periphery of the upper end of said body adjacent said loop.

3. Dispensing apparatus comprising a housing defined by a plurality of modules, one of said modules having an outlet and a dispensing means for dispensing granular material through said outlet, an agitator adjacent said dispensing means and rotatably driven thereby within said one module, locking means releasably interconnecting said module, said locking means including an integral loop projecting outwardly from an upper end of one module, an integral tab projecting downwardly from the lower edge of the next module thereabove, said tab entering said loop, said tab having a locking surface for engaging a bottom surface of said loop, said tab being hinged to its module and biased outwardly toward the bight of said loop, a cam on said one module and a cam follower associated with said tab, said cam cooperating with said cam follower to bias said tab in a direction toward said bight of said loop, said cam being generally opposite said bottom surface of said loop.

4. Apparatus in accordance with claim 3 including a cover, said cover being connected to the upper edge of the uppermost module, said cover being provided with a hinge intermediate its ends, said hinge being adjacent one end of said cover.

5. Dispensing apparatus comprising a housing defined by a plurality of modules, one of said modules having an outlet and a dispensing means for dispensing granular material through said outlet, an agitator adjacent said dispensing means and rotatably driven thereby within said one module, locking means releasably interconnecting said modules, said locking means including an integral loop projecting outwardly from an upper end of one module, an integral tab projecting downwardly from the lower edge of the next module thereabove, said tab entering said loop, said tab having a locking surface for engaging a bottom surface on said loop, said tab being hinged to its module and biased outwardly toward the bight of said loop, the uppermost module having a downwardly extending flange telescoped into the module therebelow and a downwardly extending tongue extending into a groove in the module therebelow thereby forming a labyrinth seal, said tongue being shorter than said last-mentioned flange.

6. Apparatus comprising first and second hollow plastic bodies, means coupling said bodies together in generally axial alignment so that the interiors of said hollow bodies communicate with one another, said coupling means including an integral loop projecting outwardly from a wall of said first body at the upper end of said first body, said second body having an integral tab projecting from the lower end thereof, said tab having a locking surface spaced from the lower end thereof, said tab extending downwardly through said loop on said first body and being latched thereto by contact between its locking surface and a contact surface of the loop, a cam on said first body at an elevation generally opposite the contact surface of said loop, said tab having a portion for contacting said cam and biasing the locking surface of said tab toward the loop for contact with said surface of the loop.

7. Apparatus in accordance with claim 6 wherein said tab has a pair of locking surfaces for contact with said contact surface of the loop, said locking surfaces being spaced from one another, said portion of said tab being between said locking surfaces and being separated from the portion of the tab containing the locking surfaces by a pair of slots in said tab.

8. Apparatus in accordance with claim 6 wherein said loop is stationary and fixedly secured to said first body only at its ends, said locking surface being part of a cam on said tab, said tab extending beyond said cam so as to provide a finger contact extension at an elevation below the elevation of said contact surface on said loop to facilitate disengagement of said locking surface and said contact surface on said loop.

9. Apparatus in accordance with claim 6 wherein said tab is connected to the lower end of said second body by an integral hinge having a thickness which is substantially thinner than the thickness of said tab, said hinge biasing the lower end of said tab away from a vertical plane containing said hinge and in a direction toward said loop.

* * * * *